US010500110B2

(12) United States Patent
Taschner

(10) Patent No.: US 10,500,110 B2
(45) Date of Patent: Dec. 10, 2019

(54) WHEELCHAIR LOADING SYSTEM

(71) Applicant: Tyler Taschner, Hayti, SD (US)

(72) Inventor: Tyler Taschner, Hayti, SD (US)

( * ) Notice: Subject to any disclaimer, the term of this patent is extended or adjusted under 35 U.S.C. 154(b) by 88 days.

(21) Appl. No.: 15/627,934

(22) Filed: Jun. 20, 2017

(65) Prior Publication Data

US 2018/0360676 A1 Dec. 20, 2018

(51) Int. Cl.
*A61G 3/02* (2006.01)
*A61G 3/06* (2006.01)

(52) U.S. Cl.
CPC ..... *A61G 3/0209* (2013.01); *A61G 3/061* (2013.01); *A61G 3/062* (2013.01)

(58) Field of Classification Search
CPC ..... A61G 3/02; A61G 3/0209; A61G 3/08; A61G 3/085; A61G 3/062; A61G 3/06; A61G 3/067; A61G 3/0808; A61G 2220/145; A61G 2220/14; B60P 1/022; B60P 1/6427; B60P 1/6436; B60P 1/5457; B65F 3/001; B65F 2003/0269; B65F 1/006
See application file for complete search history.

(56) References Cited

U.S. PATENT DOCUMENTS 4,010,859 A * 3/1977 Ronian ..... A61G 3/06 254/327
4,155,587 A * 5/1979 Mitchell ..... B60N 2/245 296/65.12
4,215,849 A * 8/1980 Charland ..... B21D 1/14 254/226
4,272,218 A * 6/1981 Carter ..... B60R 9/0426 224/310
4,544,321 A 10/1985 Lanier
5,052,879 A 10/1991 Wolfe
5,096,361 A 3/1992 Crawford
5,299,904 A 4/1994 Simon
5,308,214 A 5/1994 Crain
5,445,488 A 8/1995 Saucier
5,486,082 A * 1/1996 Feldman ..... B60P 1/54 212/252
6,582,181 B2 6/2003 Suehiro
6,821,078 B2 11/2004 Dudai
6,837,670 B2 1/2005 Goodrich
(Continued)

FOREIGN PATENT DOCUMENTS

FR 3000666 A1 * 7/2014 ..... A61G 3/00
JP 2013052194 A * 3/2013

*Primary Examiner* — Glenn F Myers

(57) ABSTRACT

A wheelchair loading system facilitates loading of a wheelchair into a vehicle by the user of the wheelchair without additional assistance from another person. The system includes a rail assembly configured for coupling to a vehicle. A shuttle and a motor are each coupled to the rail assembly to move the shuttle on the rail assembly. A chair mount has a first end couplable to the shuttle and a second end configured for coupling to a wheelchair. The shuttle is positionable at a rearward end of the rail assembly positioning the wheelchair away from the rear door to allow the rear door to be opened while the wheelchair is coupled to the shuttle. A lift is configured for coupling to the vehicle and includes a strap having a free end configured for coupling to the wheelchair for lifting the wheelchair into the vehicle through the rear door.

18 Claims, 6 Drawing Sheets

(56) References Cited

U.S. PATENT DOCUMENTS

| | | | | |
|---|---|---|---|---|
| 9,937,088 | B2 * | 4/2018 | Guertler | A61G 3/0808 |
| 2004/0100388 | A1 * | 5/2004 | Yoshida | B60N 2/002 340/686.1 |
| 2012/0230803 | A1 * | 9/2012 | Goedken | B65F 3/001 414/408 |
| 2013/0142604 | A1 * | 6/2013 | Esparza | B60P 1/5433 414/546 |
| 2013/0343862 | A1 * | 12/2013 | Tindall | A61G 3/062 414/809 |
| 2015/0173984 | A1 | 6/2015 | Kitchin | |
| 2016/0280114 | A1 * | 9/2016 | Baxter, Jr. | B60R 9/08 |
| 2018/0297193 | A1 * | 10/2018 | Garfield | A61M 1/00 |

* cited by examiner

WHEELCHAIR LOADING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to loading devices and more particularly pertains to a new loading device for facilitating loading of a wheelchair into a vehicle by the user of the wheelchair without additional assistance from another person.

BRIEF SUMMARY OF THE INVENTION

An embodiment of the disclosure meets the needs presented above by generally comprising a rail assembly configured for coupling to a vehicle. A shuttle and a motor are each coupled to the rail assembly to move the shuttle on the rail assembly. A chair mount has a first end couplable to the shuttle and a second end configured for coupling to a wheelchair. The shuttle is positionable at a rearward end of the rail assembly positioning the wheelchair away from the rear door to allow the rear door to be opened while the wheelchair is coupled to the shuttle. A lift is configured for coupling to the vehicle and includes a strap having a free end configured for coupling to the wheelchair for lifting the wheelchair into the vehicle through the rear door.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
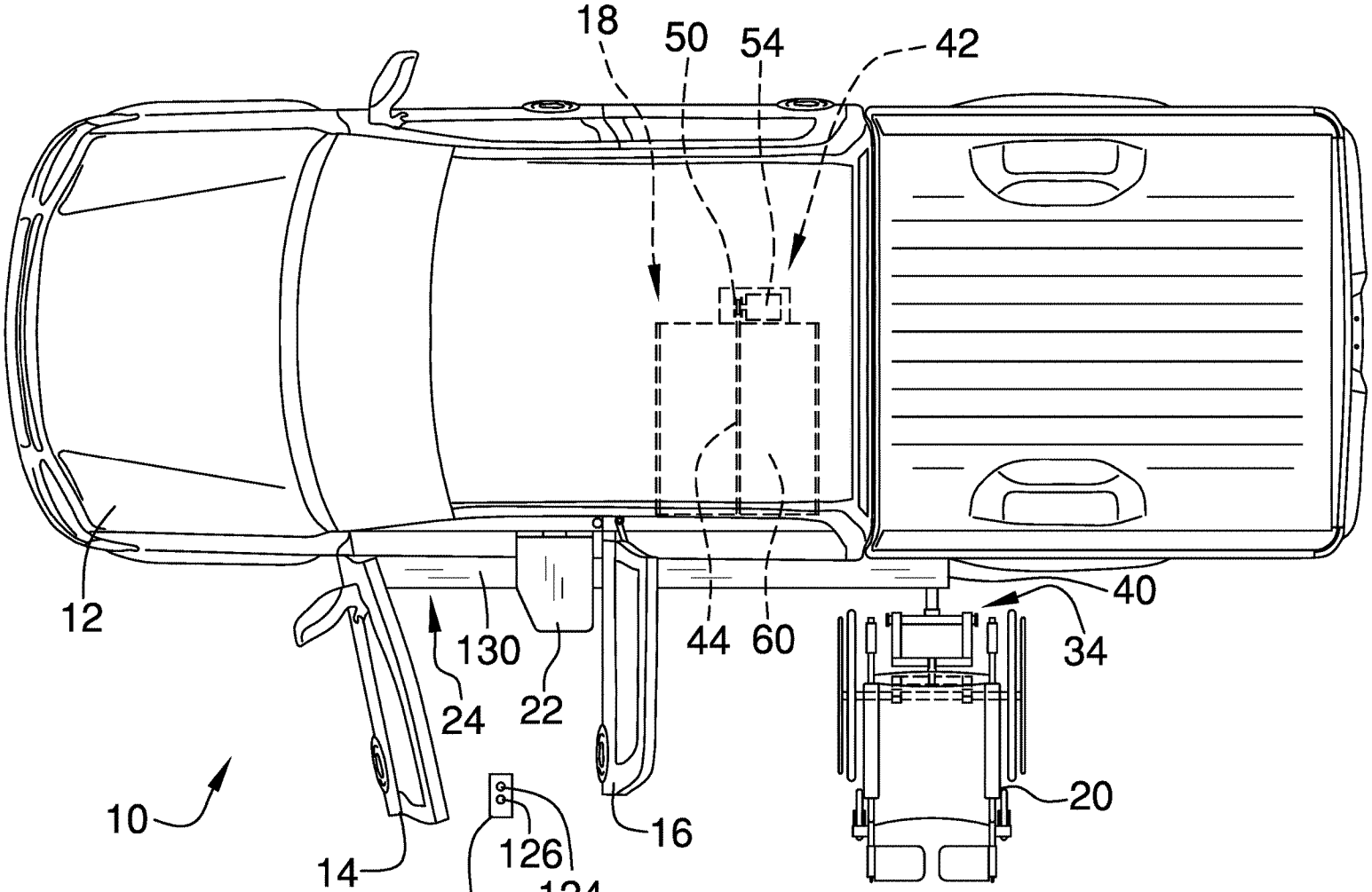
FIG. 1 is a top view of a wheelchair loading system according to an embodiment of the disclosure.
Figure 2:
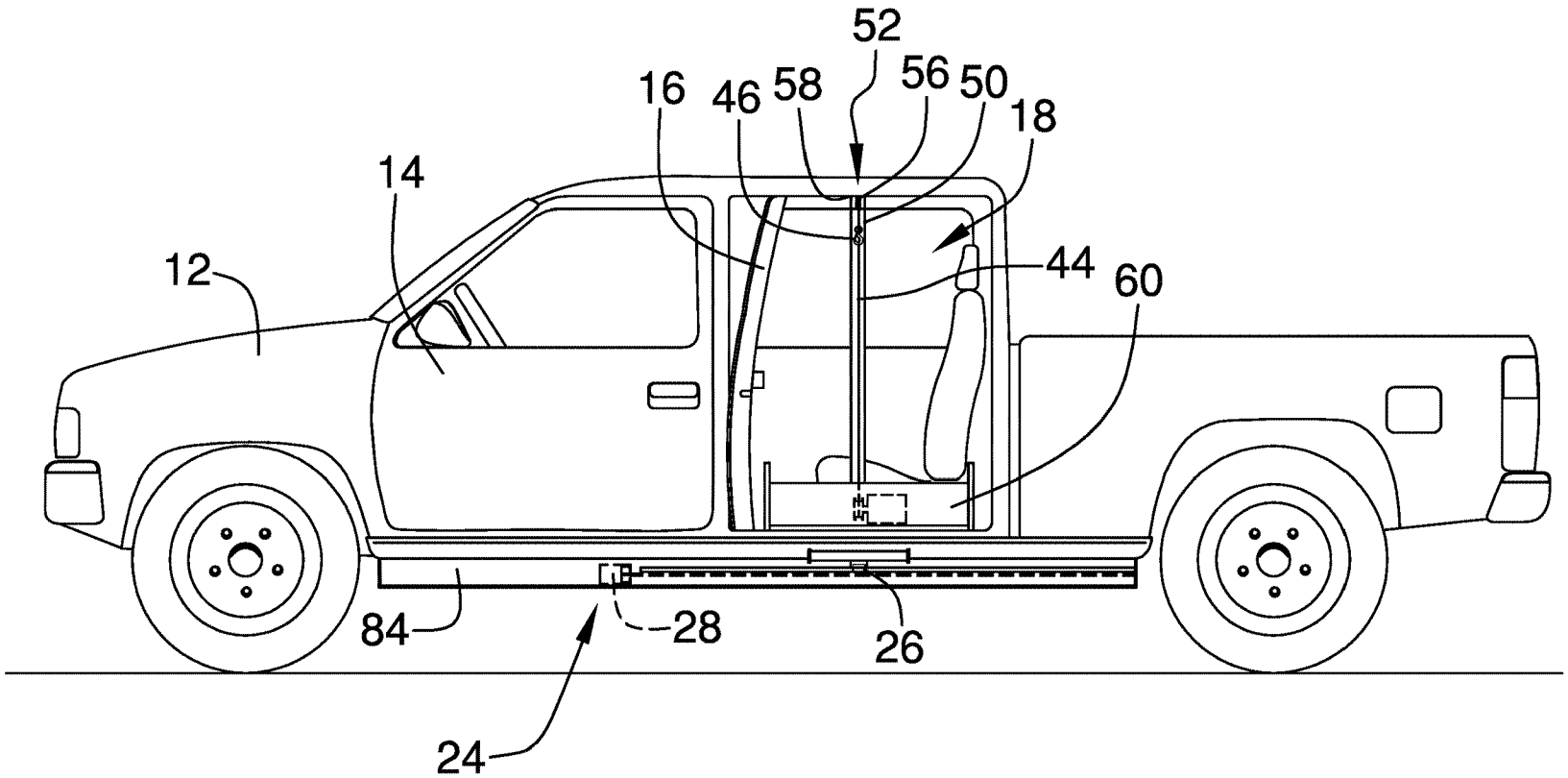
FIG. 2 is a front view of an embodiment of the disclosure.
Figure 3:
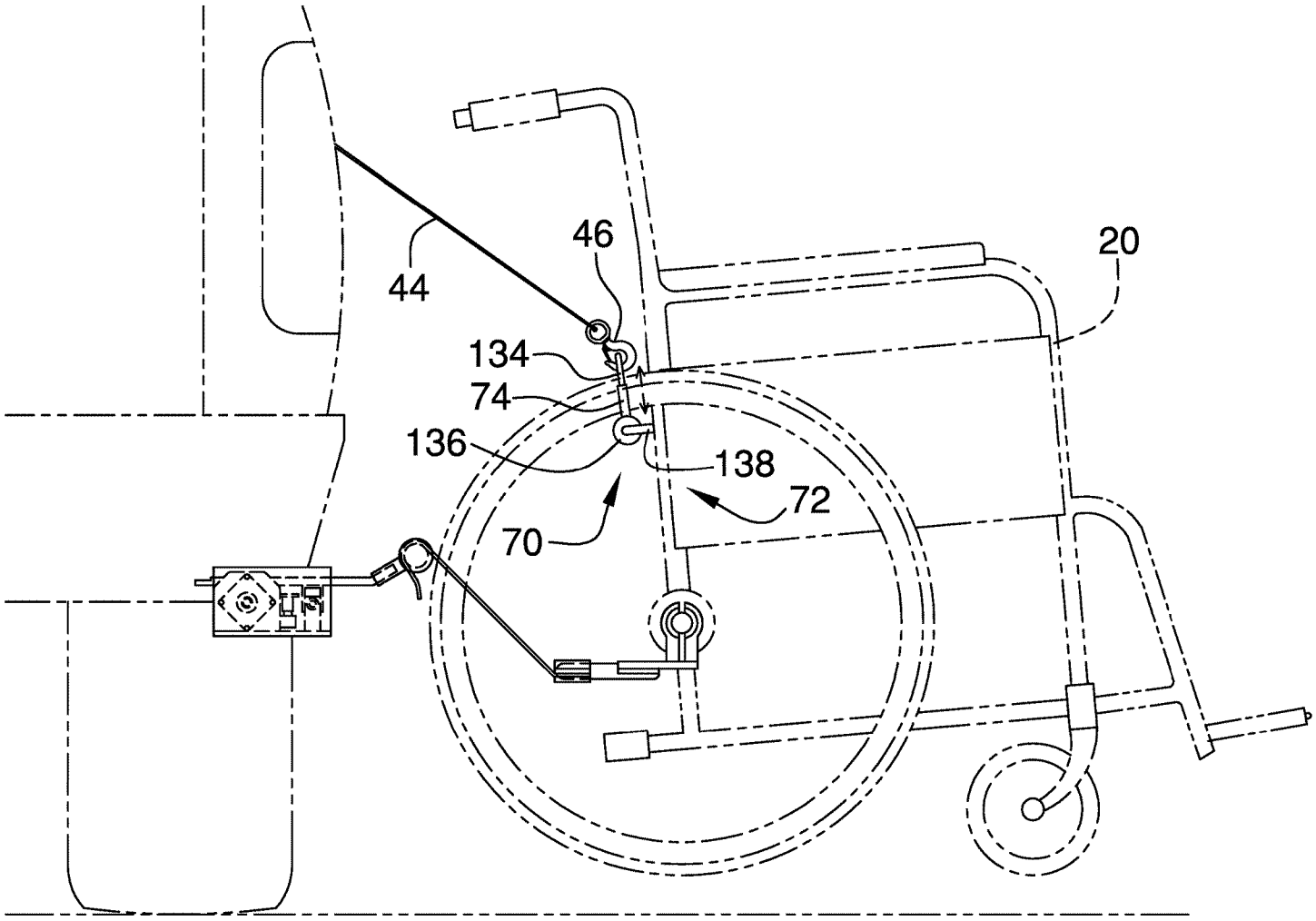
FIG. 3 is a side view of an embodiment of the disclosure.
Figure 4:
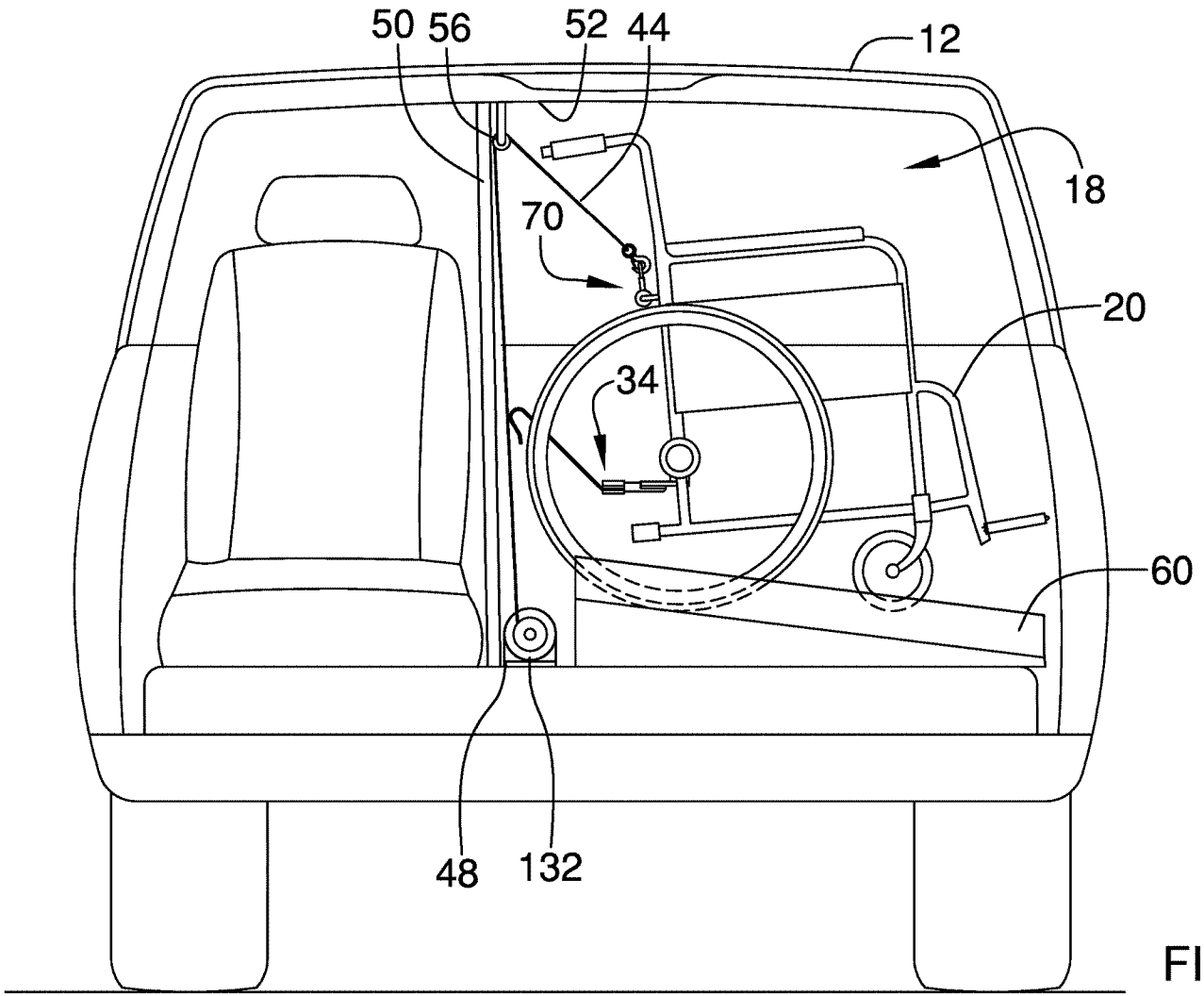
FIG. 4 is a partial cut-away side view of an embodiment of the disclosure.
Figure 5:
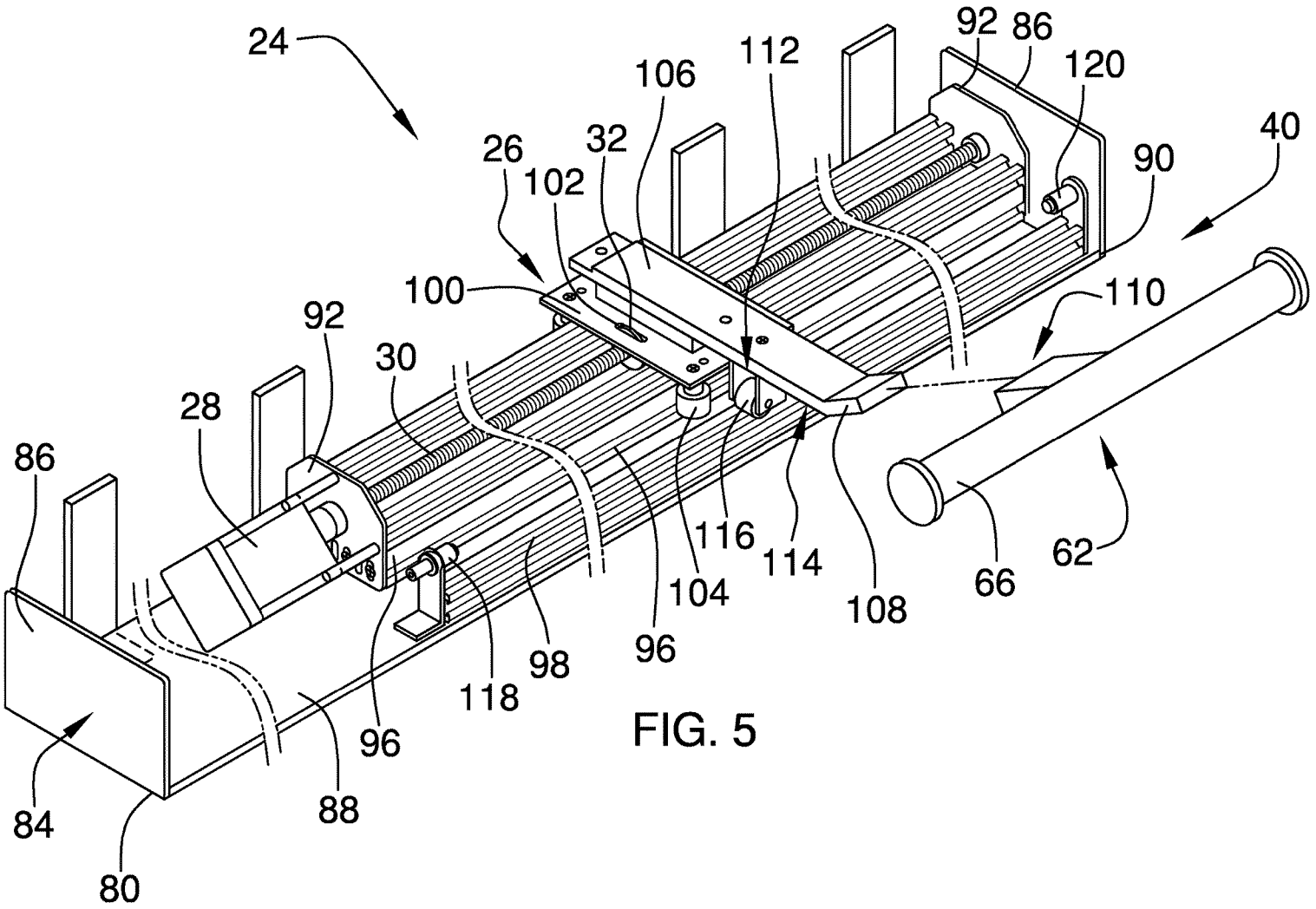
FIG. 5 is a top front side perspective view of a rail assembly of an embodiment of the disclosure.
Figure 6:
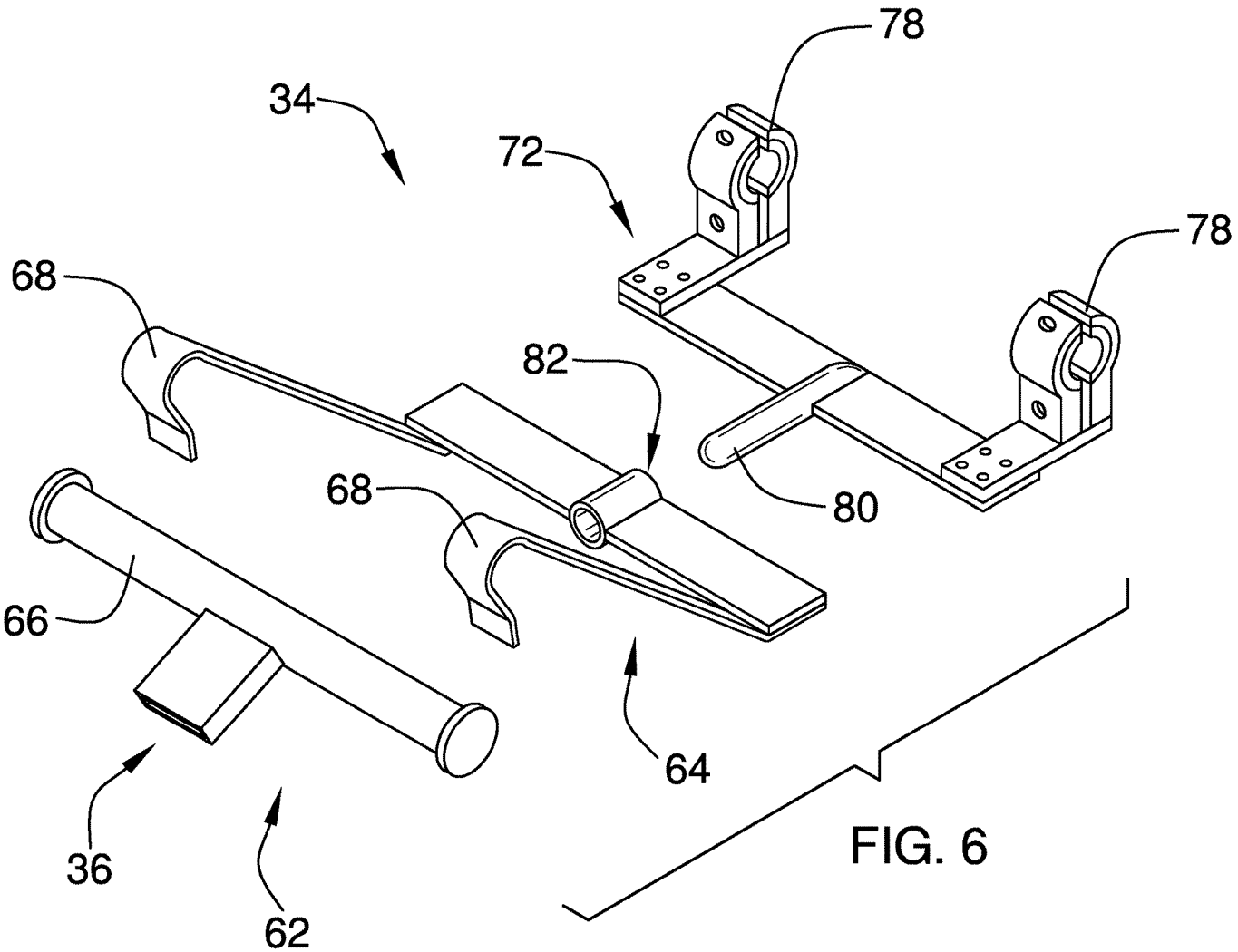
FIG. 6 is an exploded view of a chair connection assembly of an embodiment of the disclosure.

With reference now to the drawings, and in particular to FIGS. 1 through 6 thereof, a new loading device embodying the principles and concepts of an embodiment of the disclosure and generally designated by the reference numeral 10 will be described.

As best illustrated in FIGS. 1 through 6, the wheelchair loading system 10 generally comprises a vehicle 12. The vehicle 12 is of the type commonly known as a crew cab pickup truck but the system 10 as described may be employed to any vehicle having the characteristics described herein for operation of the system 10. The vehicle 12 has a driver door 14 and a rear door 16. The rear door 16 is adjacent to the driver door 14. The vehicle 12 has a cabin 18 accessible through the rear door 16. The cabin 18 may be cleared of conventional seating to provide room for a wheelchair 20 and the elements of the system 10 as described herein. The rear door 16 is openable such that the rear door 16 extends at least perpendicularly from the vehicle 12 to maximize the opening of the rear door 16 to facilitate the wheelchair 20 to pass through the opening into the cabin 18. This can be achieved through modification of a rear door hinge in a conventional manner to allow the rear door 16 to open farther than when using a conventional original equipment manufactured rear door hinge. A seat 22 is configured for coupling to the vehicle 12 such that the seat 22 is extendable out of the driver door 14. The seat 22 may be of a type which folds, slides, or otherwise extends from the vehicle 12 while the driver door 14 is in an open position. The seat 22 is stowed within the vehicle 12 to allow for regular driver seating within the cabin 18 with the driver door 14 closed. When deployed, the seat 22 allows the driver to sit upon the seat 22 while having access to the area immediately adjacent to the rear door 16.

A rail assembly 24 is coupled to the vehicle 12 such that the rail assembly 24 extends from forward of the rear door 16 of the vehicle 12 to rearward of the rear door 16 of the vehicle 12. The rail assembly 24 is positioned to extend under the rear door 16 generally in the position of a conventional foot rail or step rail common to many vehicles. A shuttle 26 and a motor 28 are each coupled to the rail assembly 24. The motor 28 is operationally coupled to the shuttle 26 such that the motor 28 moves the shuttle 26 on the rail assembly 24. A worm gear 30 coupled to and extends from the motor 28. The worm gear 30 extends through a threaded nut 32 engaging the shuttle 26 wherein rotation of the worm gear 30 urges the shuttle 26 to move along the rail assembly 24. The motor 28 provides for rotation in opposite directions to move the shuttle 26 either forwardly or rearwardly on the rail assembly 24. The rail assembly 24 may have a top wall 130 as can be seen in FIG. 1. The top wall 130 is not present in FIG. 5.

A chair mount 34 has a first end 36 removably coupled to the shuttle 26 and a second end 38 configured to be coupled to the wheelchair 20 such that the wheelchair 20 is moved along the rail assembly 24 with the shuttle 26. The shuttle 26 is positionable at a rearward end 40 of the rail assembly 24 such that the shuttle 26 is configured for positioning the wheelchair 20 away from the rear door 16 to allow the rear door 16 to be opened while the wheelchair 20 is coupled to the shuttle 26.

A lift 42 is coupled to the vehicle 12. The lift 42 includes a strap 44, or the like, having a free end 46 configured for coupling to the wheelchair 20 when the wheelchair 20 is aligned with the opening of the rear door 16. The lift 42 is positioned within the cabin 18 of the vehicle 12 wherein the lift 42 is configured for lifting the wheelchair 20 and pulling the wheelchair 20 into the cabin 18 through the opening of the rear door 16. The lift 42 is designed for minimal modification of the vehicle 12 for installation and includes a base plate 132 coupled to a floor 48 of the cabin 18. A post 50 is coupled to and extends upwardly from the base plate 132 such that the post 50 extends between the base plate 132 and a roof 52 of the cabin 18. Thus, the post 50 is held in a static position within the cabin 18. A winch 54 is positioned within the cabin 18 in a static position relative to the post 50. The winch 54 may be attached directly to the base plate 132. A pulley 56, or the like, is coupled to the post 50 proximate an upper end 58 of the post 50. The strap 44 extends from the winch 54 through the pulley 56.

A ramp 60 is positioned in the cabin 18. The ramp 60 is aligned with the opening of the rear door 16. The ramp 60 slants downwardly towards the opening of the rear door 16 wherein the ramp 60 is configured for the wheelchair 20 to roll out of the opening of the rear door 16 when the strap 44 is extended sufficiently from the winch 54. The slanting of the ramp 60 and the ramp 60 providing a planar surface being free of any obstructions allows gravity to move the wheelchair 20 outwardly from the cabin 18 without other required pushing or release of any retainer other than connection to the strap 44.

The chair mount 34 mentioned above more specifically provides for automatic decoupling and coupling of the wheelchair 20 from the shuttle 26 as would be needed to allow a single person positioned on the seat 22 to store and deploy the wheelchair 20 while the rear door 16 is opened. The chair mount 34 includes a first section 62 and a second section 64. The first section 62 includes the first end 36 of the chair mount 34 and a mounting rod 66. The mounting rod 66 is parallel to the rail assembly 24 when the first section 62 is engaged to the shuttle 26. The second section 64 includes a pair of hooks 68. The second section 64 is removably coupled to the first section 62 by engagement of the pair of hooks 68 to the mounting rod 66. The pair of hooks 68 disengage from the mounting rod 66 as the strap 44 is retracted by the winch 54 as the wheelchair 20 is lifted towards the cabin 18. The second section 64 is retained on the wheelchair 20 while the wheelchair 20 is positioned in the cabin 18. Conversely, the pair of hooks 68 is lowered onto and engages the mounting rod 66 when the strap 44 is extended from the winch 54 as the wheelchair 20 is lowered from the cabin 18. The second section 64 may be removably engaged to the wheelchair 20 such that the second section 64 is not required to be fixed to the wheelchair 20 while the wheelchair 20 is not being stored within the cabin 18. The chair mount 34 may employ a mount bracket 76 having clamps 78 for coupling to an axle of the wheelchair 20. The mount bracket 76 includes a projection 80 insertable into a receiver 82 in the second section 64 to removably engage the second section 64 to the mount bracket 76. The pair of hooks 68 is offset from the receiver 82 such that the second section 64 being engaged to the mounting rod 66 lifts rear wheels of the wheelchair 20 slightly facilitating lateral movement of the wheelchair 20 by the shuttle 26.

A winch attachment bracket 70 is coupled to a back 72 of the wheelchair 20 wherein the free end 46 of the strap 44 is engageable to the winch attachment bracket 70. A hook, carabiner, or the like may be used to facilitate engagement of the free end 46 to the winch attachment bracket 70. The winch attachment bracket 70 may attach to a standard or conventional cross bar 138 on the back 72 of the wheelchair 20 using a clamp 136. The winch attachment bracket 70 may have a telescopic shaft 74 allowing an attachment portion 134 of the winch attachment bracket 70 to be positioned at a height such that the attachment portion 134 is accessible through an open window or around the rear door 16 to allow the strap 44 to be attached or detached while the rear door 16 is open.

The rail assembly 24 includes a housing 84 having opposed end walls 86 and a base wall 88 coupled to and extending between bottom edges 90 of the end walls 86. Each of a pair of interior walls 92 is coupled to and extends upwardly from the base wall 88. Each of a plurality of main rails 94 is coupled to and extends between the interior walls 92. Each of the main rails 94 has a respective track 96 extending along a length of the main rail 94. The motor 28 is mounted to one of the interior walls 92 closest to the driver door 14. The worm gear 30 extends through the one of the interior walls 92 and extends between the interior walls 92 between and parallel to the main rails 94. The rail assembly 24 may also include a support rail 98 coupled to the housing 84. The support rail 98 is laterally spaced from and parallel to the main rails 94.

The shuttle 26 includes a base 100 having a slot 102. The slot 102 is perpendicular to the main rails 94. The threaded nut 32 is positioned to extend through the slot 102. Each of a plurality of rollers 104 is coupled to the base 100. Each of the rollers 104 is positioned within an associated one of the tracks 96. The shuttle 26 includes an attachment plate 106 coupled to the base 100. The attachment plate 106 extends from the base 100 perpendicularly relative to the main rails 94. The attachment plate 106 has an upwardly angled distal portion 108 relative to the base 100. The first end 36 of the chair mount 34 is a socket 110 insertably receiving the distal portion 108 of the attachment plate 106. The attachment plate 106 extends over the support rail 98. A support wheel assembly 112 is coupled to an underside 114 of the attachment plate 106. The support wheel assembly 112 extends vertically between the attachment plate 106 and the support rail 98. The support wheel assembly 112 includes a wheel 116 resting on and rolling along the support rail 98 as the shuttle 26 is moved on the rail assembly 24.

A forward sensor 118 is coupled to the rail assembly 24. The forward sensor 118 is operationally coupled to the motor 28 wherein the motor 28 is deactivated when the shuttle 26 is sensed by the forward sensor 118 to be close to the forward end of the rail assembly 24. Similarly, a rearward sensor 120 is coupled to the rail assembly 24. The rearward sensor 120 is operationally coupled to the motor 28 wherein the motor 28 is deactivated when the shuttle 26 is sensed by the rearward sensor 120 to be close to the rearward end of the rail assembly 24. The forward sensor 118 and rearward sensor 120 may be linearly aligned with the support rail 98 and positioned to sense individually, or in combination, a position of the wheel support assembly 112 between the forward sensor 118 and the rearward sensor 120.

A remote control 122 is provided. A motor activation button 124 is positioned on the remote control 122. The motor activation button 124 is operationally coupled to the motor 28 via a transmitter or conventional operational communication, wherein the motor 28 is selectively activated by manipulation of the motor activation button 124. The motor 28 may be operationally coupled to a program which controls direction of the motor 28 to move the shuttle 26 according to a desired sequence and positioning, or the motor 28 may simply be alternatively activated alternatively in each direction allowing a person to select the direction of movement for the shuttle 26 by repeated manipulation of the motor activation button 124. Similarly, a winch button 126 is positioned on the remote control 122. The winch button 126 is operationally coupled to the winch 54 wherein the winch 54 is selectively activated by manipulation of the winch button 126 in a manner similar to operation of the motor 28 by manipulation of the motor activation button 124.

In use, a person using the wheelchair 20 may open the driver door 14 and deploy the seat 22. After transferring to the seat 22, the second section 64 of the chair mount 34 is attached to the mount bracket 76 and the first section 64 of the chair mount 34 is attached to the attachment plate 106. The motor activation button 124 is manipulated to move the shuttle 26 such that the wheelchair 20 is clear of the rear door 16. The rear door 16 may then be opened and the motor activation button 124 manipulated to position the wheelchair 20 in alignment with the rear door 16. The free end 46 of the strap 44 may then be attached to the winch attachment bracket 70 and the winch 54 activated to pull the wheelchair 20 into the cabin 18. The rear door 16 may then be closed and the person can move into the driver's seat within the cabin 18 to operate the vehicle 12. The process is reversed to deploy the wheelchair 20 and position the wheelchair 20 to be accessible to the person after parking of the vehicle 12.

In an embodiment used specifically with an extended cab type vehicle, or any other conventional vehicle which might have a rear hinged type rear door, commonly referred to as a "suicide door", the rail assembly 24 is not needed as the rear hinged door would not interfere with positioning and connection of the wheelchair 20. The lift 42 as described above is utilized as described and still provides for minimal modifications to be made to a stock vehicle to allow single person storage and deployment of the wheelchair 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. Further, the various elements described above may be used in various combinations to conform to the use with variations in vehicle type and structure. The embodiments shown demonstrate how the various elements operate but are not intended to restrict use of the elements in combinations not specifically shown in the drawing figures. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wheelchair loading system comprising:

a vehicle, said vehicle having a driver door and a rear door, said rear door being adjacent to said driver door, said vehicle having a cabin accessible through said rear door;

a rail assembly coupled to said vehicle such that said rail assembly extends from forwardly of said rear door of said vehicle to rearwardly of said rear door of said vehicle;

a shuttle coupled to said rail assembly;

a motor coupled to said rail assembly, said motor being operationally coupled to said shuttle such that said motor moves said shuttle on said rail assembly;

a chair mount having a first end removably coupled to said shuttle and a second end configured to be coupled to a wheelchair such that the wheelchair is moved along said rail assembly with said shuttle, wherein said shuttle is positionable at a rearward end of said rail assembly such that said shuttle is configured for positioning the wheelchair away from the rear door to allow the rear door to be opened while the wheelchair is coupled to said shuttle; and a lift coupled to said vehicle, said lift including a strap having a free end configured for coupling to the wheelchair when the wheelchair is aligned with the rear door.

2. The system of claim 1, further comprising said lift being positioned within said cabin of said vehicle wherein said lift is configured for lifting the wheelchair and pulling the wheelchair into said cabin through said rear door.

3. The system of claim 1, further comprising a seat being configured for coupling to the vehicle such that said seat is extendable out of the driver door.

4. The system of claim 1, further comprising a ramp positioned in said cabin, said ramp being aligned with said rear door.

5. The system of claim 4, further comprising said ramp slanting downwardly towards said rear door wherein said ramp is configured for the wheelchair to roll out of said rear door when said strap is extended from said lift.

6. A wheelchair loading system comprising:

a vehicle, said vehicle having a driver door and a rear door, said rear door being adjacent to said driver door, said vehicle having a cabin accessible through said rear door;

a rail assembly coupled to said vehicle such that said rail assembly extends from forwardly of said rear door of said vehicle to rearwardly of said rear door of said vehicle;

a shuttle coupled to said rail assembly;

a motor coupled to said rail assembly, said motor being operationally coupled to said shuttle such that said motor moves said shuttle on said rail assembly;

a chair mount having a first end removably coupled to said shuttle and a second end configured to be coupled to a wheelchair such that the wheelchair is moved along said rail assembly with said shuttle, wherein said shuttle is positionable at a rearward end of said rail assembly such that said shuttle is configured for positioning the wheelchair away from the rear door to allow the rear door to be opened while the wheelchair is coupled to said shuttle, said chair mount comprising a first section and a second section, said first section including said first end of said chair mount, said first section including a mounting rod, said mounting rod being parallel to said rail assembly, said second section comprising a pair of hooks, and said second section being coupled to said first section by engagement of said pair of hooks to said mounting rod, said pair of hooks disengaging from said mounting rod as said strap is retracted by said winch as the wheelchair is lifted towards said cabin, said pair of hooks being lowered onto and engaging said mounting rod when said strap is extended from said winch as the wheelchair is lowered from said cabin; and a lift coupled to said vehicle, said lift including a strap having a free end configured for coupling to the wheelchair when the wheelchair is aligned with the rear door.

7. The system of claim 1, further comprising a forward sensor being coupled to said rail assembly, said forward sensor being operationally coupled to said motor wherein said motor is deactivated when said shuttle is sensed by said forward sensor to be close to said forward end of said rail assembly.

8. The system of claim 1, further comprising a rearward sensor being coupled to said rail assembly, said rearward sensor being operationally coupled to said motor wherein said motor is deactivated when said shuttle is sensed by said rearward sensor to be close to said rearward end of said rail assembly.

9. The system of claim 1, said lift comprising:

a base plate coupled to a floor of said cabin, a post coupled to and extending upwardly from said base plate wherein said post extends between said base plate and a roof of said cabin; and a winch, said winch being coupled to said base plate.

10. The system of claim 9, said lift further comprising a pulley coupled to said post proximate an upper end of said post, said strap extending from said winch through said pulley.

11. The system of claim 1, further comprising:

a worm gear coupled to and extending from said motor; and a threaded nut, said worm gear extending through said threaded nut, said threaded nut engaging said shuttle wherein rotation of said worm gear urges said shuttle to move along said rail assembly.

12. The system of claim 1, further comprising said rear door being openable such that said rear door extends perpendicularly from said vehicle.

13. The system of claim 1, further comprising:

a remote control;

a motor activation button positioned on said remote control, said motor activation button being operationally coupled to said motor wherein said motor is activated by manipulation of said motor activation button; and a winch button positioned on said remote control, said winch button being operationally coupled to said winch wherein said winch is activated by manipulation of said winch button.

14. The system of claim 1, further comprising a winch attachment bracket, said winch attachment bracket being coupled to a back of said wheelchair wherein said free end of said strap is engageable to said winch attachment bracket.

15. The system of claim 11, said rail assembly comprising:

a housing having opposed end walls and a base wall coupled to and extending between bottom edges of said end walls;

a pair of interior walls, said interior walls being coupled to and extending upwardly from said base wall;

a plurality of main rails coupled to and extending between said interior walls, each of said main rails having a respective track extending along a length of said main rail;

said motor being mounted to one of said interior walls;

said worm gear extending through said one of said interior walls and extending between said interior walls between and parallel to said main rails.

16. The system of claim 15, said shuttle comprising:

a base, said base having a slot, said slot being perpendicular to said main rails, said threaded nut being positioned to extend through said slot;

a plurality of rollers coupled to said base, each of said rollers being positioned within an associated one of said tracks;

an attachment plate, said attachment plate being coupled to said base, said attachment plate extending from said base perpendicularly relative to said main rails, said attachment plate having an upwardly angled distal portion relative to said base, said first end of said chair mount being a socket insertably receiving said distal portion of said attachment plate.

17. The system of claim 16, further comprising:

said rail assembly including a support rail coupled to said housing, said support rail being laterally spaced from and parallel to said main rails, said attachment plate extending over said support rail; and a support wheel assembly being coupled to an underside of said attachment plate, said support wheel assembly extending between said attachment plate and said support rail, said support wheel assembly including a wheel resting on and rolling along said support rail as said shuttle is moved on said rail assembly.

18. A wheelchair loading system comprising:

a vehicle, said vehicle having a driver door and a rear door, said rear door being adjacent to said driver door, said vehicle having a cabin accessible through said rear door, said rear door being openable such that said rear door extends perpendicularly from said vehicle;

a seat being configured for coupling to the vehicle such that said seat is extendable out of the driver door;

a rail assembly coupled to said vehicle such that said rail assembly extends from forwardly of said rear door of said vehicle to rearwardly of said rear door of said vehicle, said rail assembly being positioned to extend under said rear door;

a shuttle coupled to said rail assembly;

a motor coupled to said rail assembly, said motor being operationally coupled to said shuttle such that said motor moves said shuttle on said rail assembly;

a worm gear coupled to and extending from said motor;

a threaded nut, said worm gear extending through said threaded nut, said threaded nut engaging said shuttle wherein rotation of said worm gear urges said shuttle to move along said rail assembly;

a chair mount having a first end removably coupled to said shuttle and a second end configured to be coupled to a wheelchair such that the wheelchair is moved along said rail assembly with said shuttle, wherein said shuttle is positionable at a rearward end of said rail assembly such that said shuttle is configured for positioning the wheelchair away from the rear door to allow the rear door to be opened while the wheelchair is coupled to said shuttle;

a lift coupled to said vehicle, said lift including a strap having a free end configured for coupling to the wheelchair when the wheelchair is aligned with the rear door, said lift being positioned within said cabin of said vehicle wherein said lift is configured for lifting the wheelchair and pulling the wheelchair into said cabin through said rear door, said lift comprising a base plate coupled to a floor of said cabin, a post coupled to and extending upwardly from said base plate wherein said post extends between said base plate and a roof of said cabin, a winch, said winch being coupled to said base plate, and a pulley coupled to said post proximate an upper end of said post, said strap extending from said winch through said pulley;

a ramp positioned in said cabin, said ramp being aligned with said rear door, said ramp slanting downwardly towards said rear door wherein said ramp is configured for the wheelchair to roll out of said rear door when said strap is extended from said lift;

said chair mount comprising a first section, said first section including said first end of said chair mount, said first section including a mounting rod, said mounting rod being parallel to said rail assembly, and a second section, said second section comprising a pair of hooks, said second section being coupled to said first section by engagement of said pair of hooks to said mounting rod, said pair of hooks disengaging from said mounting rod as said strap is retracted by said winch as the wheelchair is lifted towards said cabin, said pair of hooks being lowered onto and engaging said mounting rod when said strap is extended from said winch as the wheelchair is lowered from said cabin;

a forward sensor being coupled to said rail assembly, said forward sensor being operationally coupled to said motor wherein said motor is deactivated when said shuttle is sensed by said forward sensor to be close to said forward end of said rail assembly;

a rearward sensor being coupled to said rail assembly, said rearward sensor being operationally coupled to said motor wherein said motor is deactivated when said shuttle is sensed by said rearward sensor to be close to said rearward end of said rail assembly;

a winch attachment bracket, said winch attachment bracket being coupled to a back of said wheelchair wherein said free end of said strap is engageable to said winch attachment bracket;

said rail assembly comprising a housing having opposed end walls and a base wall coupled to and extending between bottom edges of said end walls, a pair of interior walls, said interior walls being coupled to and extending upwardly from said base wall, a plurality of main rails coupled to and extending between said interior walls, each of said main rails having a respective track extending along a length of said main rail, said motor being mounted to one of said interior walls, said worm gear extending through said one of said interior walls and extending between said interior walls between and parallel to said main rails, and a support rail coupled to said housing, said support rail being laterally spaced from and parallel to said main rails;

said shuttle comprising a base, said base having a slot, said slot being perpendicular to said main rails, said threaded nut being positioned to extend through said slot, a plurality of rollers coupled to said base, each of said rollers being positioned within an associated one of said tracks, and an attachment plate, said attachment plate being coupled to said base, said attachment plate extending from said base perpendicularly relative to said main rails, said attachment plate having an upwardly angled distal portion relative to said base, said first end of said chair mount being a socket insertably receiving said distal portion of said attachment plate, said attachment plate extending over said support rail;

a support wheel assembly being coupled to an underside of said attachment plate, said support wheel assembly extending between said attachment plate and said support rail, said support wheel assembly including a wheel resting on and rolling along said support rail as said shuttle is moved on said rail assembly;

a remote control;

a motor activation button positioned on said remote control, said motor activation button being operationally coupled to said motor wherein said motor is activated by manipulation of said motor activation button; and a winch button positioned on said remote control, said winch button being operationally coupled to said winch wherein said winch is activated by manipulation of said winch button.

* * * * *